United States Patent [19]

Minami et al.

[11] 4,065,920

[45] Jan. 3, 1978

[54] TWO BARREL CARBURETOR

[76] Inventors: Hidehiro Minami, No. 1403, Matano-cho, Totsuka, Yokohama; Makio Waku, No. 1-22-6, Motomachi, Urawa, both of Japan

[21] Appl. No.: 663,140

[22] Filed: Mar. 2, 1976

[30] Foreign Application Priority Data

Mar. 7, 1975 Japan ..... 50-31752[U]

[51] Int. Cl.[2] ..... F02B 75/10

[52] U.S. Cl. ..... 60/276; 60/285; 123/119 EC; 123/127; 261/23 A; 261/41 C; 261/121 B

[58] Field of Search ..... 60/276, 285; 123/119 R, 123/127, 119 EC; 261/121 B, 23 A, 41 C

[56] References Cited

U.S. PATENT DOCUMENTS

| | | | |
|---|---|---|---|
| 2,152,951 | 4/1969 | Bracke | 261/23 A |
| 3,364,911 | 1/1968 | Baudry | 261/23 A |
| 3,738,341 | 6/1973 | Loos | 60/276 |
| 3,861,366 | 1/1975 | Masaki | 123/119 R |
| 3,899,551 | 8/1975 | Korte | 261/121 B |
| 3,906,910 | 9/1975 | Szlaga | 123/119 R |
| 3,921,612 | 11/1975 | Aono | 123/119 R |
| 3,942,493 | 3/1976 | Linder | 123/119 R |
| 3,960,118 | 6/1976 | Konomi | 60/276 |

*Primary Examiner*—Douglas Hart
*Attorney, Agent, or Firm*—Robert E. Burns; Emmanuel J. Lobato; Bruce L. Adams

[57] ABSTRACT

A two barrel carburetor is disposed in an intake system of an internal combustion engine having a catalytic converter in the exhaust system thereof. One of the barrels is a conventional carburetor barrel, while the other one of the barrels is provided with a fuel nozzle through which fuel is fed into the barrel, the amount of which being controlled by a fuel controller electronically receiving information signals from an exhaust gas composition sensor disposed in the exhaust system at a position upstream of the catalytic converter.

6 Claims, 1 Drawing Figure

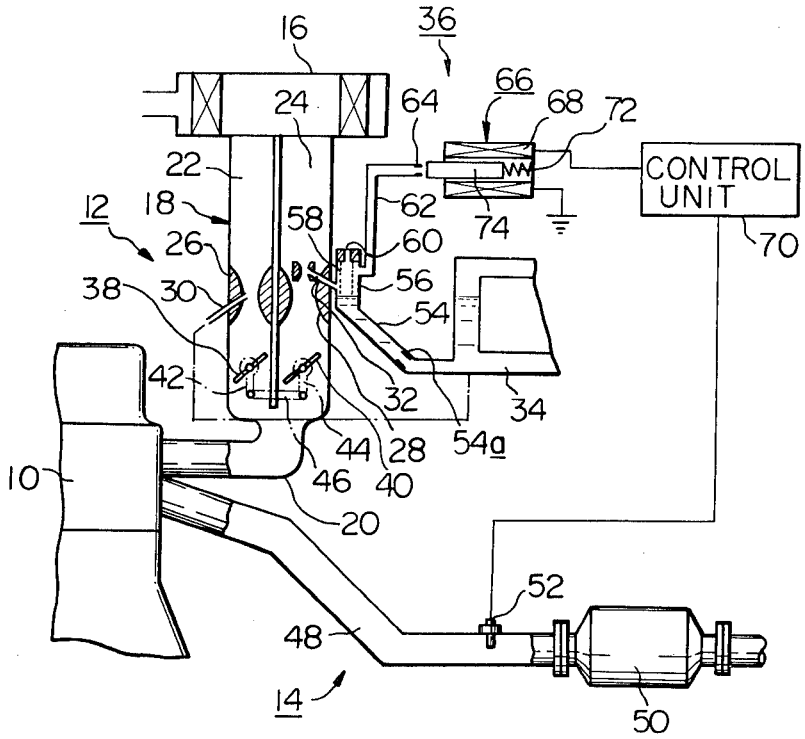
16
36
24
64
66
68
72
CONTROL UNIT
22
12
18
58
62
74
70
26
60
56
38
30
54
42
32
34
44
28
54a
10
46
40
20
52
48
14
50

TWO BARREL CARBURETOR

BACKGROUND OF THE INVENTION

The present invention relates in general to an exhaust gas purifying system used with an internal combustion engine of a motor vehicle and more particularly to an electronically controlled two barrel carburetor for the internal combustion engine having at the exhaust system thereof a triple catalytic converter, the electronically controlled two barrel carburetor being operated in response to the composition of the engine exhaust gases being fed into the triple catalytic converter.

It is recognized that a triple catalytic converter arranged in an exhaust system of an internal combustion engine can convert the harmful compounds such as hydrocarbons (HC), carbon monoxide (CO) and nitrogen oxides ($NO_x$) contained in the engine exhaust gases into harmless compounds by the activating action of a catalyst or catalysts contained in the triple catalytic converter. In this kind of catalytic converter, the highest purifying performance of it occurs when the air-fuel mixture subjected to conventional combustion in the combustion chambers of the engine is kept within an extremely limited range of the stoichiometric air-fuel ratio.

A variety of devices have thus far been proposed and put into practice to maintain the air-fuel mixture supplied into the combustion chambers for its conventional combustion at the stoichiometric ratio, one of which is an electronically controlled carburetor which can electronically control the amount of fuel and/or air, accordingly the air-fuel ratio of the air-fuel mixture, being fed into the intake manifold of the internal combustion engine is in accordance with the composition of the exhaust gases from the engine. Thus, the air-fuel mixture being fed into the combustion chamber for conventional combustion is kept at the stoichiometric air-fuel ratio. This type of carburetor has been proposed because of an obvious mutual relation existing between the constituents of the exhaust gases from the engine and the air-fuel ratio of the mixture fed into the combustion chambers for the conventional combustion, as is well known to those skilled in the art.

However, in this kind of a carburetor, the air-fuel ratio of the air-fuel mixture being fed into the intake manifold is varied in steps by the valve operation of an electric controller used for controlling the amount of fuel or air feeding into the intake manifold. Furthermore, when the controller is an ON-OFF operation type solenoid valve, a remarkable variation of the air-fuel ratio of the mixture occurs in the intake manifold at the moment when one state of the solenoid valve is changed to the other, thereby causing the air-fuel ratio of the mixture supplied the combustion chambers to markedly deviate from the stoichiometric ratio. Furthermore, in a worst case, "hunting phenomenon" occurs.

SUMMARY OF THE INVENTION

Therfore, it is an object of the present invention to provide an improved two barrel carburetor system which can eliminate the drawbacks and demerits encountered in the prior art carburetor system mentioned above.

It is another object of the present invention to provide an improved two barrel carburetor system in which the air-fuel mixture passing through one of the barrels of the carburetor is subjected to electronic feedback control depending on exhaust gas composition.

It is still another object of the present invention to provide an improved two barrel electronically controlled carburetor system which can prevent the unwanted variation of the air-fuel ratio of the air-fuel mixture being fed into the intake manifold.

It is a further object of the present invention to provide an improved two barrel electronically controlled carburetor system which can provide an internal combustion engine with smooth operation.

BRIEF DESCRIPTION OF THE DRAWING

These and other objects and advantages of the present invention will become more apparent from the following detailed description taken in conjunction with the accompanying single drawing.

DESCRIPTION OF THE PREFERRED EMBODIMENTS

Referring now to the single drawing, there is shown part of an internal combustion engine 10 incorporating an intake system and an exhaust system which are generally designated by reference numerals 12 and 14, respectively.

The intake system 12 generally comprises an air filter 16, an electronically controlled two-barrel carburetor 18 and an intake tube 20. As shown, the electronically controlled two barrel carburetor 18 includes first and second barrels 22 and 24 in which first and second venturi portions 26 and 28 are provided respectively. Respectively projected into the first and second barrels 22 and 24 from the first and second venturi portions 26 and 28 are first and second fuel nozzles 30 and 32 which are so arranged that the first fuel nozzle 30 is fluidly connected to a float chamber 34 through a conventional mechanism (not shown), while the second fuel nozzle 32 is fluidly connected to an electronically controlled fuel supply means 36 which includes the float chamber 34 and which will be well described hereinlater. First and second throttle valves 38 and 40 are respectively mounted in the first and second barrels 22 and 24 at positions downstream of the venturi portions 26 and 28 so as to rotate with respective throttle valve shafts (no numeral) connected thereto and rotatably mounted in the first and second barrels 22 and 24. Connected to the throttle valve shafts and extending downwardly are first and second throttle valve operating arms 42 and 44 which are pivotally connected at the lower ends thereof to both ends of a rod 46 in such a manner that the two throttle valves 38 and 40 are simultaneously and synchronously rotated when the rod 46 is moved. Thus, the operating arms 42 and 44 and the rod 46 constitute a so-called synchronous mechanism. Although not shown in this drawing, the rod 46 is connected to a throttle valve operating wire or lever so as to transmit a movement of an accelerator pedal (not shown) to it. Furthermore, a return spring, though not shown, is provided in the carburetor 18 to urge the throttle valves 38 and 40 in a direction to close the two barrels 22 and 24. Furthermore, though not shown, a low-speed circuit is provided in the carburetor 18 to supply the proper amount of air-fuel mixture for the engine 10 at idle and extremely low speeds.

The exhaust system 14 generally comprises an exhaust tube 48 and a triple catalytic converter 50 containing therein a catalyst or catalysts having the function to assist to convert the harmful compounds such as hydrocarbons (HC), carbon monoxide (CO) and nitrogen oxides ($NO_x$) into harmless compounds.

Projected into the exhaust tube 48 at a portion upstream of the triple catalytic converter 50 is an exhaust gas composition sensor 52 such as an oxygen sensor which generates information signals about the oxygen concentration in the exhaust gases in the exhaust tube 48.

Referring back to the second fuel nozzle 32 in the second barrel 24, the electronically controlled fuel supply means 36 is shown as including the float chamber 34, a fuel conduction passage 54 having an orifice portion 54*a* therein and fluidly connected to the lower portion of the float chamber 34. On the top end portion of the fuel conduction passage 54 is arranged an air mixing chamber 56 which is fluidly connected at the lower portion thereof to the second fuel nozzle 32 and contains therein an air mixing tube 58 havng a plurality of holes. As shown, the air mixing chamber 56 is provided at the top portion thereof with an air vent 60 acting as a primary air bleed passage and at the side portion thereof with an air passage 62 acting as a secondary air bleed passage. The secondary air bleed passage 62 has an orifice portion 64 at the open end thereof, as shown.

Adjacent to the open end of the air passage 62, there is positioned a magnetic valve unit 66 which comprises a solenoid coil 68 one end of which is grounded and the other is electrically connected to a control unit 70. Slidably disposed in the solenoid coil 68 and backed by a spring 72 is a valve plunger 74 which has a valve head at the outward end thereof for selectively opening and closing the opening of the orifice portion 64 of the air passage 62 upon receiving command signals from the control unit 70. The magnetic valve unit 66 may be replaced by a valve actuated by a servomotor. The control unit 70 is a conventional one which can issue suitable command signals to the magnetic valve unit 66 upon receiving information signals from the sensor 52 mounted in the exhaust tube 48.

The above-stated construction of the system according to the present invention is operated as follows:

During the engine operation, the air-fuel mixtures respectively provided in the first and second barrels 22 and 24 are fed into the combustion chambers of the engine 10 through respective throttle valves 38 and 40, and through the intake tube 20. The engine 10 thus issues exhaust gases into the exhaust tube 48 after combustion of the combined air-fuel mixtures in it. Under this circumstance, the sensor 52 senses the concentration of oxygen in the exhaust gases in the exhaust tube 48 and sends information signals to the control unit 70. Upon receiving the signals from the sensor 52, the control unit 70 issues suitable command signals to the magnetic valve unit 66 so that the valve plunger 74 selectively opens or closes the opening of the orifice portion 64 of the air passage 62. With this operation of the valve plunger 74, the amount of fuel being admitted into the second barrel 24 through the second fuel nozzle 32 is varied or controlled so as to keep the air-fuel mixture actually fed into the combustion chambers of the engine 10 in the stoichiometric air-fuel ratio. Thus, by this procedure, the engine 10 issues into the exhaust tube 48 exhaust gases which are most suitable to be effectively purified in the triple catalytic converter 50.

It is now to be noted that although the air-fuel ratio of the air-fuel mixture provided in the second barrel 24 downstream of the venturi portion 28 is varied in steps during the engine operation, the air-fuel ratio of the air-fuel mixture provide in the first barrel 22 downstream of the venturi portion 26 is kept almost unchanged under all states of the engine operation. Thus, when the above-stated two types of air-fuel mixtures are mixed with each other at the junction positioned downstream of the throttle valves 38 and 40 in the carburetor 18, the stepwise variation of the air-fuel ratio of the mixture from the second venturi portion 28 of the second barrel 24 is preferably restrained by the addition of the air-fuel mixture from the first venturi portion 26 of the first barrel 22. Accordingly, the concentration of the air-fuel mixture being introduced into each of the combustion chambers of the engine 10 is uniform to provide stable operation of the engine 10. The "hunting phenomenon" cannot occur in this condition.

It will also be appreciated that the amount of fuel admitted into the second barrel 24 through the second fuel nozzle 32 is so controlled as to provide the combustion chambers with air-fuel mixture having stoichiometric air-fuel ratio by the operation of the electronically controlled fuel supply means 36. Thus, the exhaust gases from the engine 10 have such properties as to be effectively purified in the triple catalytic converter 50.

Although, in the previous description, only one embodiment of the system according to the present invention is shown, the following modifications and improvements may be adopted by this invention.

1. The triple catalytic converter may be replaced by other exhaust gas purifying devices such as an oxidation catalyst converter and an exhaust gas afterburning device. With these replacements, the exhaust gases from the engine are also sufficiently treated.

2. When the inner diameter of the second barrel 24 is formed larger than that of the first barrel 22, the fuel controlling response made by the electronically controlled fuel supply means 36 is improved.

3. Although, in the single embodiment, the magnetic valve 66 is arranged to provide the air mixing chamber 56 with a so-called "bypass passage" when actuated, it is also possible to arrange such a magnetic valve unit in the fuel conduction passage 54 so as to selectively stop or pass the fuel to be introduced therethrough into the second fuel nozzle 32 from the float chamber 34.

4. The oxygen sensor 52 may be replaced by an other exhaust gas composition sensor such as a carbon monoxide sensor, a carbon dioxide sensor, a hydrocarbon sensor and a nitrogen oxide sensor.

It is further to be noted that the invention is not to be limited to the exact construction shown and described and that various changes and modifications may be made without departing from the scope of the invention, as defined in the appended claims.

What is claimed is:

1. A combination for an internal combustion engine having intake and exhaust conduit systems, comprising:

a carburetor disposed in said intake conduit system and having a float chamber and first and second barrels which are united at their downstream portions:

first and second throttle valves rotatably disposed in said first and second barrels respectively at positions upstream of the united portion of said first and second barrels, means for rotating said first and second throttle valves synchronously;

first and second fuel nozzles projecting into said first and second barrels of said carburetor at positions upstream of said first and second throttle valves;

first and second fuel lines independently providing communication for said first and second fuel nozzles with said float chamber, said float chamber being common to both fuel nozzles;

an exhaust gas sensor disposed in said exhaust conduit system for developing a signal representing and corresponding to the condition of gases exhausted from said engine; and control means communicating with said exhaust gas sensor and only said second fuel line for controlling the amount of fuel passed through said second fuel line in response to said signal applied from said exhaust gas sensor.

2. A combination as claimed in claim 1, in which said control means comprises:

an air mixing chamber connected to said second fuel line and provided with a primary air bleed passage and a secondary air bleed passage;

an electrically actuable valve means for closing and opening said secondary air bleed passage when energized and deenergized respectively; and a control unit to energize and deenergize said electrically actuable valve means in response to said signal from said exhaust gas sensor.

3. A combination as claimed in claim 1, further comprising an exhaust gas purifying device disposed in said exhaust conduit system at a position downstream of said exhaust gas sensor for converting the harmful compounds contained in the exhaust gases from said engine into harmless compounds.

4. A combination as claimed in claim 3, in which said secondary air bleed passage and said second fuel line are respectively provided with orifice portions therein.

5. A combination as claimed in claim 4, in which said electrically actuable valve means comprises a solenoid coil electrically connected to said control unit, and a valve plunger disposed in said solenoid coil, a spring in said solenoid coil biasing said plunger; said valve plunger having at its leading end a valve head sealingly attachable to an opening of said secondary air bleed passage.

6. A combination for an internal combustion engine having intake and exhaust conduit systems, comprising a carburetor disposed in said intake conduit system and having a float chamber and first and second barrels which are united at their downstream portions but upstream of the engine proper; first and second throttle valves rotatably disposed in said first and second barrels respectively at positions upstream of the united portion of said first and second barrels, means for rotating said first and second throttle valves synchronously; first and second fuel nozzles projecting into said first and second barrels of said carburetor at positions upstream of said first and second throttle valves; first and second fuel lines independently providing communication for said first and second fuel nozzles with said float chamber; said float chamber being common to said fuel nozzles; an exhaust gas sensor disposed in said exhaust conduit system for developing a signal representing or corresponding to the condition of gases exhausted from said engine; an air mixing chamber connected to said second fuel line and provided with a primary air bleed passage and a secondary air bleed passage; an electrically actuable valve means to close and open said secondary air bleed passage when energized and deenergized respectively; a control unit to energize and deenergize said electrically actuable valve means in response to said signal from said exhaust gas sensor; and an exhaust gas purifying device which is disposed in said exhaust conduit system at a position downstream of said exhaust gas sensor for converting the harmful compounds contained in the exhaust gases from said engine into harmless compounds.

* * * * *